United States Patent [19]

Torkler et al.

[11] Patent Number: 5,048,396

[45] Date of Patent: Sep. 17, 1991

[54] BYPASS VALVE

[75] Inventors: Heinz Torkler; Werner Peschel, both of Lohr/Main, Fed. Rep. of Germany

[73] Assignee: Mannesmann Rexroth GmbH, Munich, Fed. Rep. of Germany

[21] Appl. No.: 213,518

[22] Filed: Jun. 29, 1988

Related U.S. Application Data

[63] Continuation of Ser. No. 35,980, Apr. 8, 1987, abandoned.

[30] Foreign Application Priority Data

Apr. 9, 1986 [DE] Fed. Rep. of Germany ..... 3611973

[51] Int. Cl.[5] ..... F15B 13/08; F15B 13/02

[52] U.S. Cl. ..... 91/512; 91/451; 137/596.13; 137/599.2

[58] Field of Search ..... 91/451, 512; 137/596.13, 599.2

[56] References Cited

U.S. PATENT DOCUMENTS 3,878,864 4/1975 Schurger ..... 137/596.13

4,798,126 1/1989 Budzich ..... 137/596.13 X

FOREIGN PATENT DOCUMENTS 2116395 11/1971 Fed. Rep. of Germany .

*Primary Examiner*—Gerald A. Michalsky

*Attorney, Agent, or Firm*—Harness Dickey & Pierce

[57] ABSTRACT

In the neutral position of a directional control valve in which the connection of the constant pump to the consumer is interrupted the entire delivery of the constant pump is led via a bypass valve to the tank. According to the invention the regulating range of the bypass valve is increased by an additional connection which is controlled by a further piston which in the neutral position of the directional control valve is displaced by a weak spring into the open position and thus ensures a pressureless circulation of the pump working medium to the tank.

16 Claims, 2 Drawing Sheets

BYPASS VALVE

This is a continuation of U.S. patent application Ser. No. 035,980, filed Apr. 8, 1987, now abandoned.

BACKGROUND OF THE INVENTION

The invention relates to a bypass valve having the features set forth in the preamble of claim 1.

Such bypass valves, also called pressure balances, are known and control the supply flow to at least one directional control valve in such a manner that the pressure difference present at the valve and obtaining between the valve input and output is kept constant even when pressure fluctuations of the working pressure occur. Thus, the working rate remains constant even with varying working pressure.

In the attempt to increase the flow rate through a valve of specific nominal width an increased pressure difference at the valve is necessary and this simultaneously requires an increase in the regulating range of the bypass valve. A larger force is therefore necessary to open the pressure balance.

It is known (DE-PS 2,116,395) to provide the spring of a pressure balance with a biasing piston which is additionally subjected to the working pressure and thus stiffens the spring so that the pressure balance also closes at higher pressures of the pump. As long as no working pressure is present the pressure balance can easily be opened by the pump pressure against the spring force and the working medium delivered by the pump is thus connected to neutral circulation, i.e. it flows back to the tank.

The problem underlying the invention resides in constructing a bypass or shunt valve in simple manner such that in the working position of the associated directional control valve a high pressure difference is achieved for increased throughflow values and in the neutral position a low pressure difference for the pressureless circulation of the working medium.

The problem is solved according to the invention by the features set forth in the characterizing clause of claim 1.

SUMMARY OF THE INVENTION

Thus, according to the invention there is provided in parallel with the slide or valve piston of the bypass valve a further piston by which the pressureless circulation of the pump working medium is made possible. In pressureless circulation the connection of the pump delivery line to the tank via the slide piston of the bypass valve is thus closed and the return of the pump working medium takes place via the connection controlled by the second piston. This has in particular the advantage that the pressure balance when the directional control valve is not actuated, i.e. in the neutral position of the directional control valve, is not traversed by the pump flow. The flow resistance from the side of the second piston is substantially reduced. Furthermore, no uncompensated in particular dynamic forces act on the pressure balance, i.e. on the slide piston. The second piston is held in its open position by a spring with small force. The fluid delivered by the pump can flow to the tank substantially unrestricted.

As soon as one of the directional control valves is actuated the working pressure occurring at the consumer and tapped off at the associated directional control valve closes the second piston. The volume flow regulation is then in known manner solely by the slide or valve piston of the pressure balance but now the spring acting on the slide piston in the closure direction together with the working pressure can be made so stiff that a predetermined higher pressure difference occurring at the directional control valve can be regulated. The regulating range of the pressure balance is thus increased for increased flow rates whilst a bypass is opened for pressureless circulation with very low pressure losses.

Advantageous further developments of the invention, in particular with regard to various embodiments, are characterized in the subsidiary claims.

BRIEF DESCRIPTION OF THE DRAWINGS

Examples of embodiment of the invention will be explained in detail hereinafter with the aid of the drawings, wherein.

DETAILED DESCRIPTION OF THE PREFERRED EMBODIMENTS OF THE INVENTION

Figure 1:
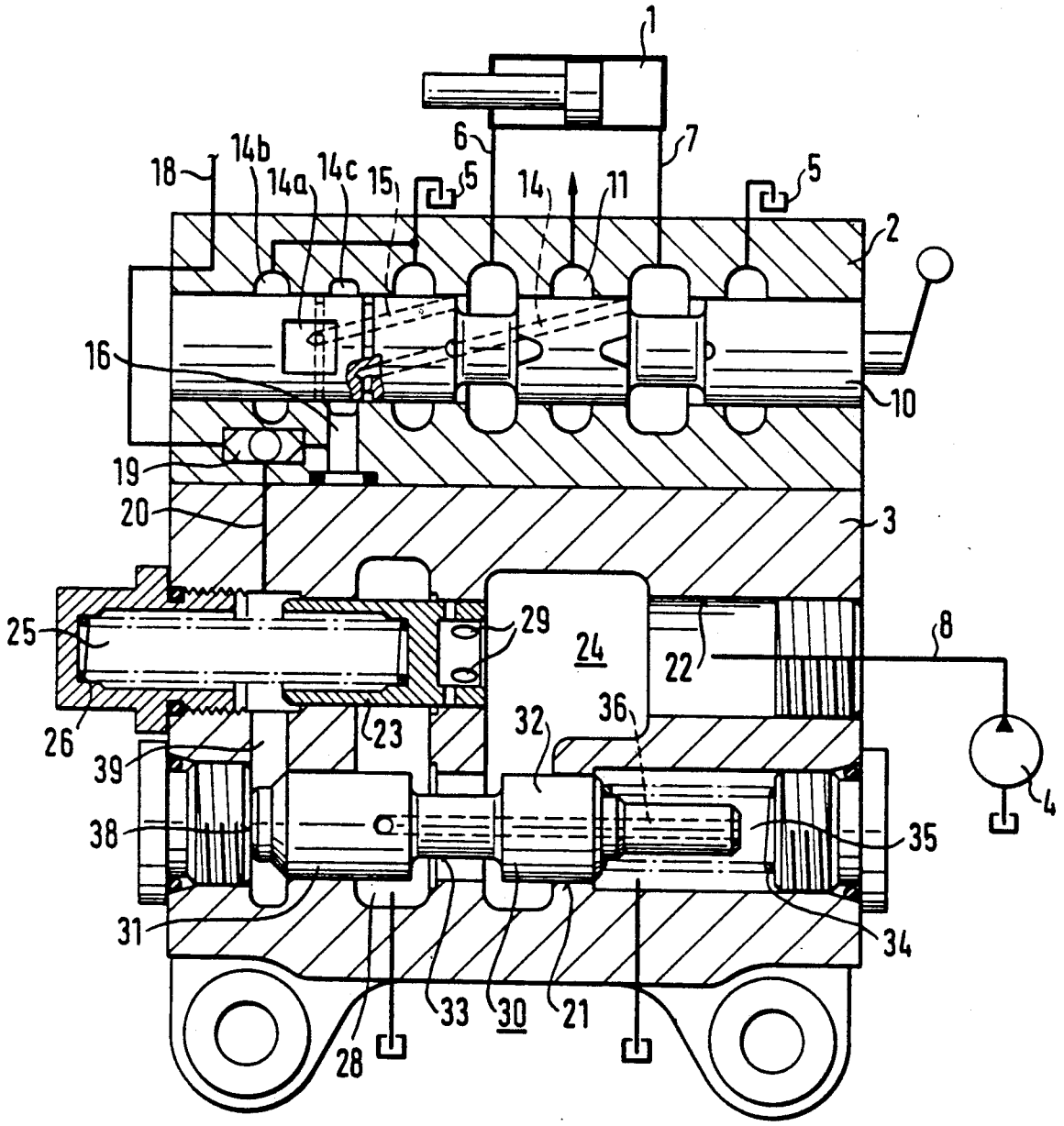
FIG. 1 shows a section through a bypass valve attached to a directional control valve.

In FIG. 1 a hydraulic cylinder 1 is connected via a directional control valve 2 and a bypass valve 3 to a constant pump 4 and to a tank 5 respectively. The lines between the cylinder 1 and the directional control valve 2 are designated by 6 and 7.

The directional control valve 2 consists in usual manner of a piston 10 from the individual piston sections of which, not designated in detail, the pump fluid in the passage 11 flows into the conduit 6 or 7 whilst the working medium displaced by the cylinder 1 is conducted to the tank 5. The working pressure obtaining in the conduits 6 or 7 is led via schematically indicated lines 14 and 15 in the piston 10 to a passage 16 on deflection of the piston 10 out of its neutral position illustrated.

In the neutral position of the directional control valve 10 illustrated the passage 16 is connected to the tank. For this purpose the passage 16 opening into a housing annular space **14*c* is connected via a recess 14*a* to an annular space 14*b*** connected to the tank.

Above the directional control valve 2 a further directional control valve can be provided, the connections of which to the pump 4 and tank 5 are provided in corresponding manner and which also has a control pressure line 18. The passage 16 and the control pressure line 18 are conducted to a shuttle valve 19 so that the particular higher working pressure is selected by the shuttle valve 19 and conducted to a control pressure line 20 of the bypass valve 3.

In the bore 22 of the bypass valve 3 a slide piston 23 is displaceably disposed. The slide or valve piston 23 is subjected on the one hand to the pressure of the working medium delivered by the pump 4 via the line 8 to the space 24 and in the opposite sense to the working pressure in the spring chamber 25 which is connected to the control pressure line 20, and to the force of a spring 26. Passage of working medium from the space 24 to a passage 28 connected to the tank 5 is via radial bores 29 in the slide piston 23 which in the position of the slide piston 23 illustrated are closed.

Provided in the bypass valve 3 parallel to the bore 22 is a further bore 21 in which a second piston 30 is displaceably disposed which between two piston sections 31 and 32 comprises an annular recess 33 via which the space 24 is connected to the passage 28 when the piston 30 is in the open position illustrated. The piston 30 is pressed into the open position by a spring 34 which is disposed in the spring chamber 35 which communicates via an axial bore 36 in the piston with the tank passage 28. The opposite end side 38 of the piston is connected via a passage 39 to the spring chamber 25 of the side piston 23.

The mode of operation is as follows: as long as the directional control valve 2 is in the neutral position illustrated the control pressure line 20 is connected to the tank. The piston 30 is thus subjected on both sides only to the tank pressure and is pressed by the spring 34 into the open position in which the entire working medium flow delivered by the pump 4 flows via the line 8 and the chamber 24 through the recess 33 to the tank passage 28. The flow resistance is extremely small and is for example only about 1 bar.

As soon as the piston 10 of the directional control valve 2 is displaced into a working position the working pressure tapped off via the line 14 or 15 or a possibly higher working pressure in the line 18 of another directional control valve passes via the line 20 into the spring chamber 25 of the slide piston 23 and further acts via the passage 39 on the end face 38 of the piston 30 which due to the relatively weak spring 34 immediately closes so that the pressureless circulation of the fluid back to the tank is interrupted. The volume flow set at the directional control valve 2 to the consumer is now regulated in the usual manner by means of the slide piston 23 which for example is pressed at a pump pressure of 6 bar into a regulated open position. Then, starting from this position for each position of the directional control valve 2 the pressure difference upstream of the directional control valve 2 is regulated constant to obtain a volume flow corresponding to the position of the directional control valve and thus a load-independent working rate at the cylinder 1 (consumer). This volume flow regulation is carried out by the slide piston 23 in the usual manner. The spring 26 for the slide piston 23 can now be designed for the necessary range of this volume flow control, i.e. in particular made stiff enough because at pressures below for example 6 bar the pressure balance need not open, instead the pressureless circulation of the working medium being effected via the additional piston 30.

Figure 2:
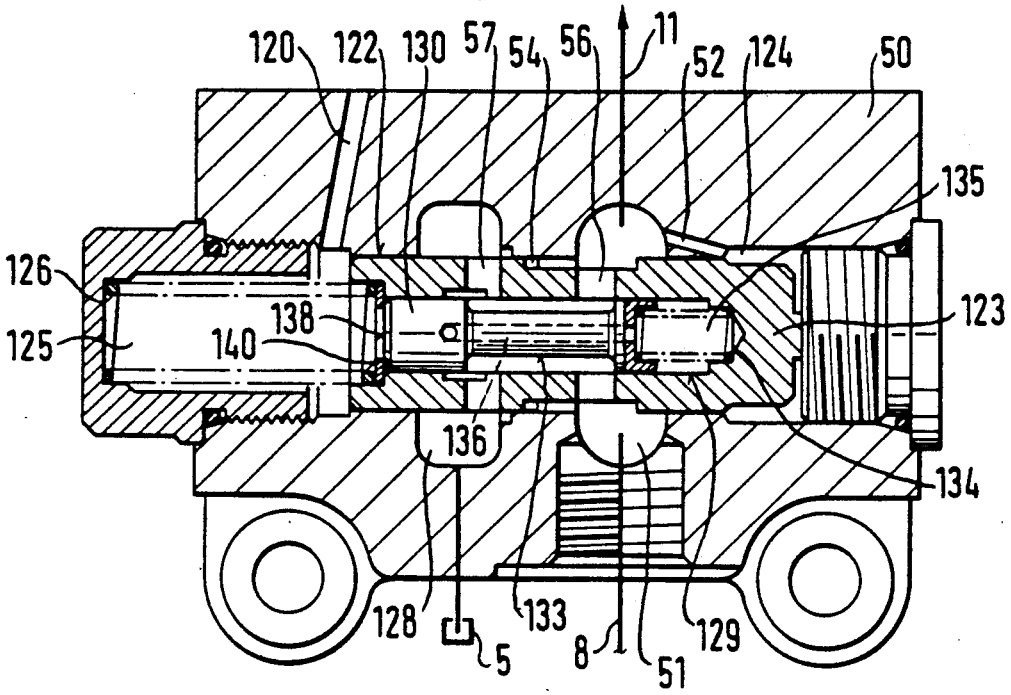
FIG. 2 shows a section through another bypass valve with hollow piston and FIG. 3 shows a section through a bypass valve having a hollow piston in a modified embodiment.

A modified embodiment of a bypass valve 50 is illustrated in FIG. 2. A pump not shown delivers via a line 8 to a passage 51 from whence the connection of the passage 11 of the associated directional control valve takes place. The space 51 is connected via a passage 52 to a space 124 in which the pump pressure obtains.

A control pressure line 120 of the associated directional control valve, which is also not illustrated, opens into a spring chamber 125 in which a spring 126 is disposed which together with the load or working pressure displaces the slide piston 123 into a regulated position against the pump pressure in the chamber 124 and in said position the connection between the passage 51 and the passage 128 connected to the tank 5 is throttled in regulated manner. The slide piston 123 comprises an annular recess 54 at its outer periphery via which working medium can flow from the passage 51 to the tank passage 128 when the slide piston 123 is displaced to the left in regulated manner. The piston 123 is disposed displaceably in the bore 122.

The slide piston 123 also comprises a blind bore 129 in which a second piston 130 is displaceably disposed. in the space 135 between the slide piston 123 and the piston 130 there is a weak spring 134. Furthermore, the space 134 is connected via an axial bore 136 in the piston 130 to the tank passage 128. The opposite end side 138 of the piston 130 faces the spring chamber 125.

In the position illustrated the piston 130 is pressed by the spring 134 to the left onto a stop 140 on the slide piston 123 or pressed by the spring 126 and thus into an open position in which the working medium delivered by the pump can freely flow into the tank passage 128 from the passage 51 and radial bores 56 in the slide piston 123, an annular recess 133 in the piston 130 and radial bores 57 in the slide piston.

As soon as the directional control valve, not illustrated, is actuated and the spring chamber 125 is no longer relieved with respect to the tank but carries the working pressure taken from the directional control valve, the piston 130 is displaced by the working pressure acting on the end side 138 to the right against the force of the spring 134 and closes the connection for the neutral circulation of the working medium in that the radial bores 57 are closed by the piston 130. The volume flow regulation is then in known manner by means of the slide piston 123 via the connection of the passage 51 and the annular recess 54 to the tank passage 128.

Figure 3:
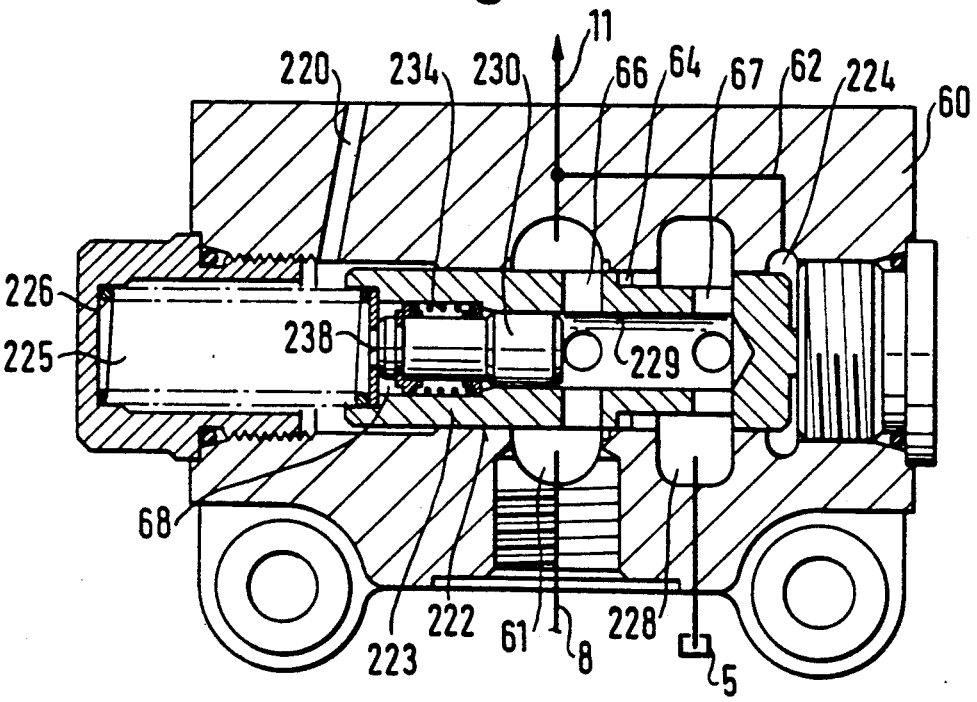

A further example of embodiment of a bypass valve 60 is shown in FIG. 3. The pump, not shown, delivers via a line 8 working medium to a passage 61 which is connected via a passage 62 to the space 224. The slide piston 223 is displaceable in the bore 222 and comprises an axial bore 229 in which a control piston 230 is displaceable disposed. Corresponding to the embodiment in FIG. 2 a control pressure line 220, a spring chamber 225 and a spring 226 for the slide piston 223 are provided.

In the position illustrated of the slide piston 223 the flow passage between the passage 61 and the passage 228 connected to the tank is shut off. The bypass via radial bores in the slide piston 223, the bore 229 and radial bores 67 in the slide piston to the tank passage 228 is open. The working medium deliverd by the pump can thus flow without appreciable throttling losses to the tank. The control piston 230 is held by a spring 234 in the open position. The spring is made as pressure spring which bears on one side on the slide piston 223 and on the other on the piston 234 and is inserted in an annular gap 68 between the two pistons. The end side 238 of the piston 230 in turn faces the spring chamber 225 and in the neutral position of the associated directional control valve relieves the control pressure line 220 of pressure towards the tank. In this manner the piston 230 is held in the open position illustrated by the spring 234.

As soon as working pressure is introduced into the spring chamber 225 said pressure acts on the end side 238 of the piston 230 and overcomes the force of the spring 234 so that the piston is displaced to the right and thus covers the radial bores 66 in the slide piston, thus closing the bypass. The volume flow regulation is then via the annular recess 64 at the outer periphery of the slide piston 223 via which the flow path from the passage 61 to the tank passage 228 is throttled to a greater or lesser extent. In this example of embodiment as well the spring 234 may be dimensioned so that in pressureless circulation the throttle losses are only about 1 bar.

As soon as the pump pressure in the passage 61 on actuation of a directional control valve reaches a magnitude of for example 6 bar the piston 230 is closed by the respective working pressure and the slide piston 223 is opened towards the tank in regulated manner so that in known manner the volume flow regulation can take place; with increasing working pressure the fluid flowing to the tank passage 228 is increasingly throttled possibly up to complete shut-off.

We claim:

1. Bypass and pressure control valve for a system comprising a load, a pump and at least one directional control valve for directional control of the working fluid from said pump to a load and from the load to a return, said directional control valve having a neutral position in which said pump does not communicate with said load, said bypass and pressure control valve being characterized by a spring-loaded slide piston normally closed with the directional control valve is in said neutral position and displaceable by the pump pressure against the load pressure of the load and the force of a spring into and opened position for regulating a flow path for the pump fluid to a tank when the directional control valve is deflected out of its neutral position and a second piston in parallel flow path with said slide piston for communicating the pump fluid to the tank when the directional control valve is in its neutral position, said connection provided by said second piston being closed when the directional control valve is deflected out of its neutral position into a working position.

2. Bypass valve according to claim 1, characterized in that both sides of the second piston are relieved of pressure when the directional control valve is in its neutral position and is held in its open position by a spring.

3. Bypass valve according to claim 2, characterized in that the second piston is subjected to the load pressure in its closure direction against the spring when the directional control valve is displaced from its neutral position.

4. Bypass valve according to claim 1 for a plurality of directional control valves, the respective load pressure at each of said directional control valves being tapped off and the highest load pressure being conducted via at least one shuttle valve to a load pressure control line, characterized in that the slide piston and the second piston are subjected to the tapped off load pressure.

5. Bypass valve according to claim 4, characterized in that the load pressure control line is connected in the neutral position of the directional control valve to the tank.

6. Bypass valve according to claim 1, characterized in that in the neutral position of the directional control valve a chamber in which the spring of the slide piston is received and the spaces facing the opposing ends of the second piston are connected to the tank.

7. Bypass valve according to claim 1, characterized in that the second piston is disposed in a bore provided parallel to a bore receiving the slide piston and the connection is formed by an annular recess in the second piston and that the chamber in which the spring of the slide piston is received and the space on the opposite side of the chamber in which the spring of the second piston is received are connected to the load pressure.

8. Bypass valve according to claim 1, characterized in that the second piston is disposed in a bore of the slide piston.

9. Bypass valve according to claim 8, characterized in that the flow path of the pump fluid to the tank is via an annular recess in the second piston into which radial bores in the slide piston open.

10. Bypass valve according to claim 8, characterized in that the second piston is biased by a spring disposed on the side opposite the spring for the slide piston.

11. Bypass valve according to claim 8, characterized in that the second piston is supported in its open position on the slide piston by the slide piston spring.

12. Bypass valve according to claim 8, characterized in that the flow path of the pump fluid to the tank is via the bore in the slide piston into which radial bores in the slide piston open whose passage is controlled by the second piston.

13. Bypass valve according to claim 12, characterized in that the second piston is biased by a pressure spring inserted into an annular gap formed between the second piston and the slide piston on the side facing the spring acting on the slide piston.

14. Bypass valve according to claim 1, characterized in that a control piston of the directional control valve comprises a recess which in the neutral position of the directional control valve connects a load pressure control line to the tank.

15. Bypass valve according to claim 14, characterized in that the recess of the control piston in the neutral position of the directional valve connects two housing annular spaces together, the first housing annular space being connected to the tank and the second housing annular space to the load pressure control line.

16. Bypass valve according to claim 15, characterized in that the second housing annular space is connected in the one working position of the directional control valve via inclined extending control bores in the control piston of the directional control valve to the load.

* * * * *